US005476410A

United States Patent [19]

Lupi

[11] Patent Number: 5,476,410

[45] Date of Patent: Dec. 19, 1995

[54] METHOD OF MACHINE WORKING MARBLE OR GRANITE

[76] Inventor: Quintilio Lupi, Via Flaminia, 138, 00068 IT Rignano Flaminio, Roma, Italy

[21] Appl. No.: 305,642

[22] Filed: Sep. 14, 1994

Related U.S. Application Data

[62] Division of Ser. No. 35,488, Mar. 22, 1993, Pat. No. 5,373,666, which is a continuation of Ser. No. 765,681, Sep. 26, 1991, abandoned.

[30] Foreign Application Priority Data

Sep. 26, 1990 [IT] Italy ..... 4830890

[51] Int. Cl.$^6$ ..... B24B 1/00

[52] U.S. Cl. ..... 451/28; 451/44; 451/56; 451/57

[58] Field of Search ..... 451/28, 41, 44, 451/42, 43, 56, 57, 58

[56] References Cited

U.S. PATENT DOCUMENTS

| | | | |
|---|---|---|---|
| 129,395 | 7/1872 | Connel | 451/545 |
| 2,772,520 | 12/1956 | Jaye | 451/541 |
| 3,057,121 | 10/1962 | Büchi et al. | 451/541 |
| 3,299,582 | 1/1967 | Kohlstrunk | 125/11.03 |
| 3,841,033 | 10/1974 | Appleby et al. | 451/28 |
| 3,946,527 | 3/1976 | Beer | 451/28 |
| 4,658,800 | 4/1986 | Larsson | 451/21 |
| 4,661,438 | 9/1986 | Siden | 451/541 |
| 4,977,709 | 12/1990 | Siden | 451/541 |
| 5,058,562 | 10/1991 | Tsotsui et al. | 125/11.03 |

FOREIGN PATENT DOCUMENTS

| | | | |
|---|---|---|---|
| 1596567 | 8/1981 | United Kingdom | 451/541 |

*Primary Examiner*—Maurina T. Rachuba
*Attorney, Agent, or Firm*—Watson, Cole, Grindle & Watson

[57] ABSTRACT

A shaped diamond wheel, at certain height, determined by both the type of grinding wheel which is being used and the working stage, is provided with a rotating feeling pin, consisting of a metal element a few millimeters high which projects for few hundreths at a millimeters with regard to the shape of grinding wheel. The rotating feeling pin does not interfere with the working of stone, with the exception of very small portion of stone (3) with come into contact with the rotating feeling pin.

4 Claims, 1 Drawing Sheet

Fig. 1.
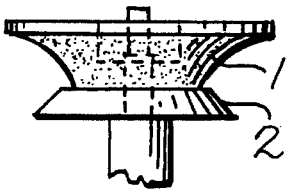
Fig. 2.
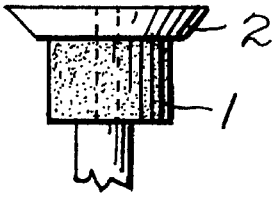
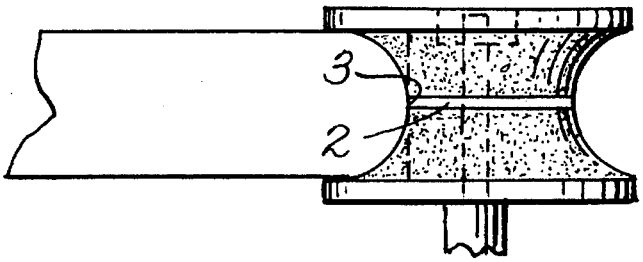
Fig. 3.
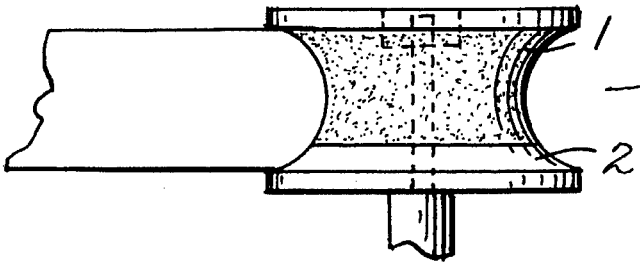
Fig. 4.
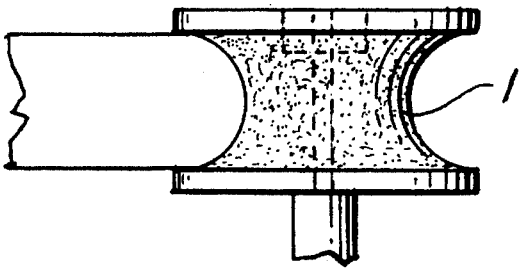
Fig. 5.
Fig. 6.
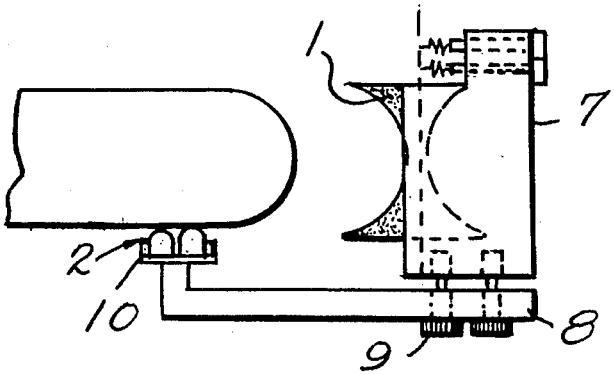

METHOD OF MACHINE WORKING MARBLE OR GRANITE

CROSS REFERENCE TO RELATED APPLICATIONS

The present application is a divisional of U.S. patent application Ser. No. 08/035,488, filed Mar. 22, 1993, now U.S. Pat. No. 5,373,666, which is in turn a continuation of U.S. patent application Ser. No. 07/765,681, abandoned Mar. 22, 1993.

FIELD OF THE INVENTION

The present invention relates to a method of machine working a stone slab into a finished form. More specifically, the present invention relates to a method of grinding, honing and polishing a of three different machine working tools.

BACKGROUND OF THE INVENTION

It is a well known fact that there are various types and sizes of chamfering machine tools currently on the market; for example, there are expensive and complex machines the structures of which allow the installation of a frame, on which the wood or steel template is fixed, which faithfully reproduces the desired shape. Besides being costly and taking up a lot of floor space, these machines also entail a lot of hard work for the construction of the necessary templates.

Smaller machines, also on the market, have been created, but these do not guarantee the execution of a perfect job.

Their major shortcoming is that, not being provided with a template of the desired shape, work is accomplished simply by the machine tool's travel end. This does not always allow the desired degree of perfection.

SUMMARY OF THE INVENTION

The object of this invention is to provide a specific grinding wheel, which may also be applied to machine tools currently on the market, which remedies the abovementioned shortcomings and, in particular, gives the possibility of working with a portable or work-table chamfering tool without having to provide a shape each time it has to be used.

The grinding wheel consists of diamond wheel shaped in such a way as to achieve the desired shape during the machine working. It is divided, cross-wise, into two portions separated by a rotating feeling pin.

The feeling pin slightly projects for several hundreths of a millimeter with regard to the internal shape outlined by the two portions of the diamond wheel. Thus, when the piece comes into contact with the rotating feeling pin during machine working, the two portions of the grinding wheel run idly, thus terminating their function.

In order to allow the perfect machine working of the piece of stone, the device is also provided with another feeling pin, installed on adjustable rotating balls, which allows all kinds of machine operations, from the grinding of curved slabs to the shaping of toroidal or other kinds of outline, with subsequent honing and polishing.

BRIEF DESCRIPTION OF THE DRAWINGS

For a better understanding of the foregoing brief summary a more detailed description follows, making reference to the specified illustrations wherein:

FIG. 1 shows a side view of a diamond wheel according to the present invention.

FIG. 2 shows a cylindrical diamond wheel according to the present invention.

FIG. 3 shows a diamond wheel for shaping according to the present invention.

FIG. 4 shows a diamond wheel for honing according to the present invention.

FIG. 5 shows a diamond wheel for polishing according to the present invention.

FIG. 6 shows a feeling pin with rotating balls according to the present invention.

DETAILED DESCRIPTION OF THE PREFERRED EMBODIMENTS

The grinding wheel works in the following manner. During the machine working of a slab of marble, for example, which needs to be cut along a non-linear profile, normal machines require the use of a template which faithfully reproduces the shape to be obtained. The template is usually made of wood. The template guides the machine so that the slab of marble is cut according to the desired shape. Such a procedure is not cost effective for small jobs because it is necessary to prepare a template for each piece.

The grinding wheel of the present invention does not require any template in order to obtain a certain shape because it abrades a piece of marble only up to a certain depth. This is accomplished by a travel limiting member. In the embodiment shown in FIG. 3, the travel limiting member is inserted between two parts of the grinding wheel, each part comprising a grinding surface. In the embodiments shown in FIGS. 1, 2 and 4, the travel limiting member is not disposed between two parts of the grinding wheel but rather adjacent a grinding wheel.

At the beginning of the machine work, the grinding wheel abrades and shapes a piece. According to the embodiment shown in FIG. 3, the travel limiting member is placed in between the two grinding surfaces. During the beginning of machine work, the rotation of the grinding surfaces is translated to rotational movement of the travel limiting member. When the shape of the piece to be machined coincides with the shape of the grinding surfaces, the travel limiting member prevents the grinding wheel from abrading any further, that is, it prevents the grinding surfaces from cutting the stone any deeper. The travel limiting member acts as a stop between the machined piece and the grinding wheel. The wheels are not able to abrade the stone deeper than the depth allowed by the travel limiting member. This makes it possible to eliminate the template required by normal marble cutting machines.

The travel limiting member may or may not protrude from the grinding surfaces of the grinding wheel. If the member does protrude, it is only for a few hundredths of a millimeter, in order to make sure that when the machined piece touches the pin there is no further abrasion. When the piece begins contacting the feeling pin, the piece can no longer advance toward the wheel. When the feeling pin comes into contact with the machine piece, the grinding wheel does not have to stop rotating but the abrading surfaces of the grinding wheel can no longer reach the stone to abrade it.

With reference to the above figures, the grinding wheels specified in this invention consist of a shaped diamond wheel (1) which, at a certain height determined by both the type of grinding wheel which is being used and the stage of machine working, is provided with a rotating feeling pin (2).

The rotating travel limiting member (2) consists of a metal element, having a thickness of a few millimeters which is suitable for the function it has to fulfill. The element projects a few hundreths of a millimeter with regard to the contour of the grinding wheel.

The rotating travel limiting member, therefore, does not influence the machine working of the stone until it is nearly finished. In fact, only when the outline of the stone coincides exactly with the outline of the grinding wheel does a small part of the stone (3) come into contact with the rotating travel limiting member (2). The contact between the travel limiting member and the stone prevents the upper and lower parts of the grinding wheel from carrying out their task, thus ending the first step of the machine working.

Obviously, during this first step of the working, a small portion of un-machined stone will remain under the travel limiting member, this will be completed by another specific grinding wheel, such as the one shown in FIG. 4 which features a travel limiting member (2) located in a different position, with regard to the previous grinding wheel of FIG. 3, thus allowing the partially unworked stone to be finished.

As may be seen from the Figures, besides being easily perceived, the grinding wheels may have different shapes, so as to be able to execute all the various possible working stages.

For example, the grinding wheel shown in FIG. 1 is particularly recommended for grinding and carrying out the so-called "owl's beak" shape.

The grinding wheel shown in FIG. 2 is useful for grinding a slab to be treated.

FIG. 5 shows an extremely fine grained grinding wheel, as you may easily see, without the rotating feeling pin and which is especially useful for polishing and finishing the previously machined piece.

In order to fix and to maintain the working depth of the piece as precisely as possible, another feeling pin, mounted on wheels 10 and which is shown in FIG. 6, has been devised. This consists of a body (7) to which the machine tool is fixed. The body (7) is provided with a square (B) which has specific adjusting screws (9) on one side and on the opposite side, small rotatable balls (10), which allow the machine to slide easily along the underside of the slab.

The foregoing invention may undergo all and any modifications, suggested by the practical employment of the tool and by expert technicians, without going beyond the invention defined in the following claims.

I claim:

1. The method of forming a stone product having a finished contour comprising, providing a first shaping wheel having a central axis and a contoured abrasive shaping surface, providing a first travel limiting means adjacent said first shaping wheel and having a central axis and a first non-abrasive surface, rotating said first shaping wheel and said first travel limiting means about the respective axes thereof, causing relative movement between a piece of stone and said first shaping wheel and first travel limiting means to cause advancing movement of the piece of stone and the abrasive shaping surface toward and into contact with one another, removing stone from said piece of stone as the advancing movement continues, continuing the advancing movement until the piece of stone contacts said first non-abrasive surface at a first location on the piece of stone, removing said piece of stone from contact with said first shaping wheel and said first travel limiting means, providing a honing wheel having a central axis and a contoured abrasive honing surface, providing a second travel limiting means adjacent said honing wheel and having a central axis and a second non-abrasive surface, rotating said honing wheel and said second travel limiting means about the respective axes thereof, causing relative movement between the piece of stone and said honing wheel and second travel limiting means to cause advancing movement of the piece of stone and the abrasive honing surface toward and into contact with one another to remove stone at said first location on said piece of stone as the advancing movement continues, and continuing the advancing movement until the piece of stone contacts said second non-abrasive surface at a second location on the piece of stone different from said first location.

2. The method as defined in claim 1, further comprising the steps of providing a second shaping wheel adjacent said first travel limiting means and having a central axis and a contoured abrasive shaping surface for shaping the outer surface of a stone, said first travel limiting means being disposed between said first shaping wheel and said second shaping wheel, rotating said second shaping wheel about its axis, causing relative movement between the piece of stone and said second shaping wheel and first travel limiting means to cause advancing movement of the piece of stone and the abrasive shaping surface of the second shaping wheel toward and into contact with one another, and removing stone from said piece of stone as the advancing movement continues.

3. The method as defined in claim 1, further comprising the steps of providing a polishing wheel having a central axis and a contoured polishing surface, rotating said polishing wheel about its axis, causing relative movement between a piece of stone and said polishing wheel to cause advancing movement of the piece of stone and the polishing wheel toward and into contact with one another, and removing stone from said piece of stone as the advancing movement between the polishing wheel and the piece of stone continues.

4. The method of forming a stone product having a finished contour comprising, providing a body, providing a grinding wheel having a central axis and a contoured abrasive shaping surface, the grinding wheel being mounted on the body for rotation about a central axis, rotating said grinding wheel about said axis, causing relative movement between a piece of stone and said body to cause advancing movement of the piece of stone and the abrasive shaping surface toward and into contact with one another in a direction substantially perpendicular to said central axis, providing separate travel limiting means spaced from and connected to said body, said travel limiting means including small rotatable balls in contact with and movable along a surface of said piece of stone, continuing said advancing movement to remove stone from said piece of stone while said balls move along said surface until said balls are prevented from moving farther along said surface, and removing said piece of stone from said grinding wheel.

* * * * *